US009788622B2

(12) United States Patent
Rendon

(10) Patent No.: US 9,788,622 B2
(45) Date of Patent: Oct. 17, 2017

(54) ACCESSORY ORGANIZATION, SECURE STORAGE AND TRANSPORTATION SYSTEM

(71) Applicant: Kathryn Rendon, Fallbrook, CA (US)

(72) Inventor: Kathryn Rendon, Fallbrook, CA (US)

( * ) Notice: Subject to any disclaimer, the term of this patent is extended or adjusted under 35 U.S.C. 154(b) by 43 days.

(21) Appl. No.: 14/949,666

(22) Filed: Nov. 23, 2015

(65) Prior Publication Data

US 2016/0073750 A1 Mar. 17, 2016

Related U.S. Application Data

(63) Continuation of application No. 13/894,892, filed on May 15, 2013, now abandoned.

(60) Provisional application No. 61/688,789, filed on May 18, 2012, provisional application No. 61/688,791, filed on May 18, 2012, provisional application No. 61/688,792, filed on May 18, 2012.

(51) Int. Cl.

| | |
|---|---|
| ***A45C 11/16*** | (2006.01) |
| ***A41D 27/02*** | (2006.01) |
| ***A41D 1/22*** | (2006.01) |
| ***A41D 27/20*** | (2006.01) |
| ***A44C 19/00*** | (2006.01) |
| ***A45C 7/00*** | (2006.01) |
| ***A45C 13/00*** | (2006.01) |
| *A47C 7/02* | (2006.01) |
| *A45C 13/02* | (2006.01) |

(52) U.S. Cl.

CPC ..... *A45C 11/16* (2013.01); *A41D 1/22* (2013.01); *A41D 27/02* (2013.01); *A41D 27/20* (2013.01); *A44C 19/00* (2013.01); *A45C 7/0095* (2013.01); *A45C 13/001* (2013.01); *A45C 13/02* (2013.01); *A47C 7/02* (2013.01)

(58) Field of Classification Search

CPC ..... A47C 7/02; A45C 11/16
USPC ..... 40/586; 206/6.1; 2/115.69
See application file for complete search history.

(56) References Cited

U.S. PATENT DOCUMENTS

| | | | | |
|---|---|---|---|---|
| 4,735,246 | A * | 4/1988 | Niehaus | A45C 7/0095 206/479 |
| 4,749,604 | A * | 6/1988 | Foster | A45C 11/16 248/205.2 |
| 5,209,344 | A | 5/1993 | Smith | |
| 5,295,587 | A | 3/1994 | Downes | |
| 5,427,230 | A | 6/1995 | Mattox | |
| 5,671,849 | A * | 9/1997 | Bacon | A47F 7/02 206/6.1 |
| 5,692,604 | A | 12/1997 | Houk | |
| 7,389,868 | B2 | 6/2008 | Lewand | |
| D657,172 | S | 4/2012 | Carr | |
| D665,203 | S | 8/2012 | Carr | |

(Continued)

*Primary Examiner* — Syed A Islam
(74) *Attorney, Agent, or Firm* — TJSL Patent Clinic; Bridget A. Madden

(57) ABSTRACT

A collapsible, foldable accessory organization, secure storage and transportation system includes a jewelry dress or other basic shape, accessory purses for organizing and storing various items, various accessory tabs for holding particular types of accessories, and a hidden inner layer upon which different accessory purses and/or tabs containing accessories can be stored in an inconspicuous manner. This hidden inner layer bears an extra security feature as it hides the jewelry on a layer under the exposed outer layer or layers where people would not think to look.

12 Claims, 16 Drawing Sheets

(56) References Cited

U.S. PATENT DOCUMENTS

| | | | |
|---|---|---|---|
| 8,312,990 | B2 | 11/2012 | Gaspari |
| 2003/0230502 | A1 | 12/2003 | Siegel |
| 2010/0155266 | A1 | 6/2010 | Nicholson |
| 2012/0062087 | A1 | 3/2012 | Havlock |
| 2013/0026119 | A1 | 1/2013 | Barron |

* cited by examiner

ACCESSORY ORGANIZATION, SECURE STORAGE AND TRANSPORTATION SYSTEM

CROSS-REFERENCE TO RELATED APPLICATIONS

This application is a continuation of U.S. patent application Ser. No. 13/894,892, filed May 5, 2013, which claims the benefit of U.S. Provisional Application No. 61/688,789, filed May 18, 2012, U.S. Provisional Application No. 61/688,791, filed May 18, 2012 and U.S. Provisional Application No. 61/688,792, filed May 18, 2012, the entire disclosures of which are incorporated herein by reference.

BACKGROUND

Field of the Application

The disclosure is directed to the field of jewelry and accessory organization, security and display. More specifically the disclosure is directed to a collapsible, foldable accessory organization, with security features and detachable transportation system.

Background of the Disclosure

Devices have long existed for storage of jewelry and accessories. Typically these devices consist of jewelry boxes which are rigid and manufactured of opaque material with limited segregated storage space and which pose the problem of not being able to readily visually identify the pieces of jewelry one is looking for due to pieces being stacked one on top of the other in a disorganized form. Further due to the rigid nature of the jewelry box, it may not be collapsed for easy transportation or storage.

Many owners of jewelry and accessories travel from one location to another for business or personal purposes and bring the jewelry along with them on these trips. To date, the packing, unpacking and safe storage of these jewelry and accessories has been a time consuming and tedious process as multiple items of different types such as necklaces, bracelets, earrings, watches, brooches, hair/clothing accessories and the like are individually manipulated. These items get tangled together and disorganized as well as may fall out of the currently available jewelry organization devices during travelling.

Other jewelry storage devices currently existing allow for organization of the jewelry in a flexible, hanging device with pockets for easy viewing and storage of jewelry but these devices do not allow for storing the jewelry in such a way that it is hidden and not readily visible to intruders entering the premises with the purpose of stealing valuables. Furthermore other flexible foldable jewelry organization and storage devices do not allow for hidden storage of the jewelry/accessories in an organized manner in removable modules which can then be transferred as separate travel totes for transportation with only the jewelry needed for a specific trip stored therein.

Therefore, what is needed in the industry is a jewelry/accessory system capable of storing multiple types of accessories in an organized manner, which also can be hidden and not readily visible to individuals targeting jewelry to steal. Further, what is needed is a system with at least one removable module, so that the module can store a desired subset of jewelry on them ready to be removed and transported as a separate travel tote during trips.

SUMMARY

In certain embodiments, an apparatus for secure accessory organization and transportation includes at least two outer exposed layers, wherein at least one of the outer exposed layers configured to receive one or more accessory display and storage modules, a foldable inner hidden layer disposed within the at least two outer exposed layers and configured to receive one or more travel purses containing organized sets of accessories, and one or more foldable, compact display and storage containers configured to receive one or more display and storage modules or one or more accessory items and configured to be stored securely on the inner hidden layer so that the storage containers and/or accessory items are not readily visible to an observer.

In certain embodiments, a method for making an apparatus for secure accessory organization and transportation includes obtaining desired materials, cutting materials into one or more pre-defined shapes, wherein the one or more pre-defined shapes include an inner hidden layer and one or more outer layers, coupling an inner hidden layer within one or more outer layers, and coupling connectors to the inner hidden layer and at least one of the one or more outer layers.

In certain embodiments, an apparatus for secure accessory organization and transportation includes means for obtaining desired materials, means for cutting materials into one or more pre-defined shapes, wherein the one or more pre-defined shapes include an inner hidden layer and one or more outer layers, means for coupling an inner hidden layer within one or more outer layers, and means for coupling connectors to the inner hidden layer and at least one of the one or more outer layers.

BRIEF DESCRIPTION OF THE DRAWINGS

The accompanying drawings, which are incorporated in and constitute a part of this specification, illustrate various exemplary embodiments of the present disclosure.

DETAILED DESCRIPTION

Figure 1:
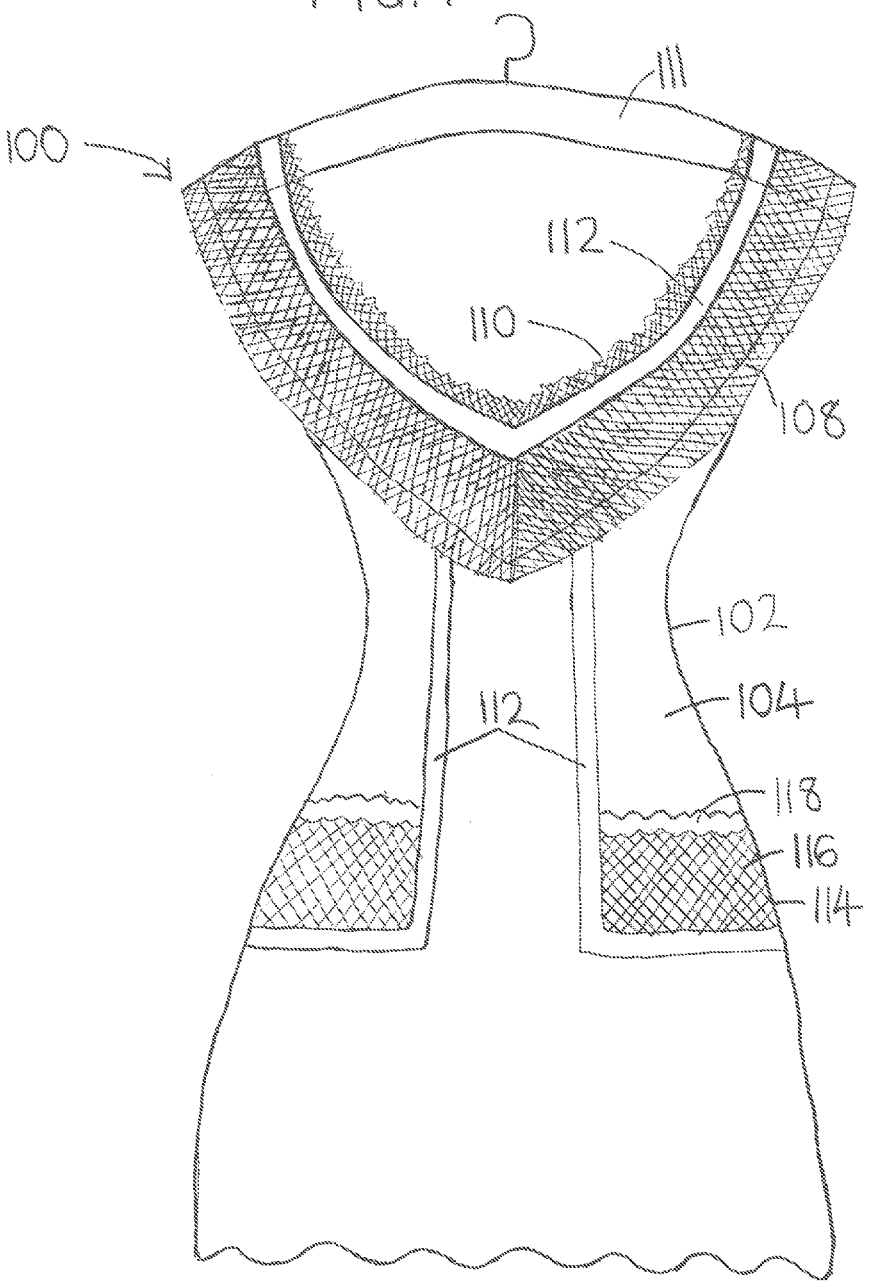
FIG. 1 illustrates an exemplary front view of an outer exposed layer of an accessory organization, secure storage and transportation system according to certain embodiments.

The following detailed description is directed to certain sample embodiments. However, the disclosure can be embodied in a multitude of different ways as defined and covered by the claims and equivalents thereof. While the accessory organization, secure storage and transportation system is shown with a number of different parts and modules for different types of jewelry and accessories, the system can be modified to include fewer parts and/or different numbers of modules. Furthermore, the accessory organization, secure storage and transportation system can be constructed in a variety of sizes and from various materials. In this description, reference is made to the drawings wherein like parts are designated with like reference numerals throughout.

Figure 2:
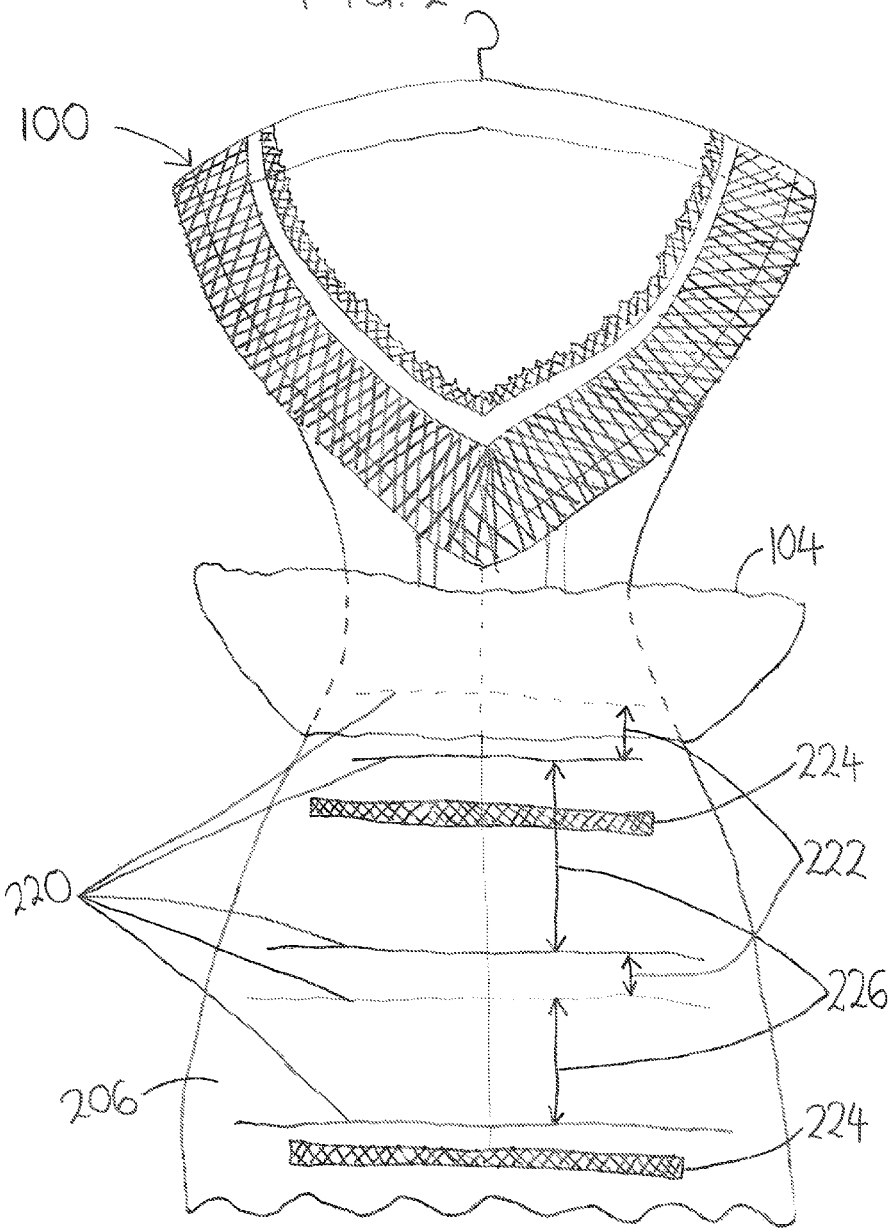
FIG. 2 illustrates an exemplary front view of an inner hidden layer of the accessory organization, secure storage and transportation system according to certain embodiments.

FIG. 1 illustrates an exemplary front view of an outer exposed layer 104 of an accessory organization, secure storage and transportation system 100 according to certain embodiments. The back view (not shown) of accessory system 100 can be identical to the front view, or not, with all elements on the front view being included on the back view. As shown in FIG. 1, exemplary accessory system 100 generally includes a jewelry dress 102 with an outer exposed dress layer 104 and an inner hidden layer 206 (shown in FIG. 2). Outer exposed dress layer 104 can be made of any variety of one or more flexible materials such as—but not limited to—woven fabrics, knit fabrics, non-woven fabrics, leather, artificial leather, vinyl, flexible composites, coated fabrics, or any other similar materials. Inner hidden layer 206 can be configured such that it is a layer separate from outer exposed dress layer 104 as shown in FIG. 2 or inner hidden layer 206 can be configured such that it is located on the opposite, inner side of outer exposed dress layer 104. Inner hidden layer 206 can be accessed by lifting up outer exposed dress layer 104 in order to expose inner hidden dress layer. Alternatively, inner hidden layer 206 can be accessed by a unzipping a zip that is coupled to outer exposed dress layer 104 to expose inner hidden dress layer. Inner hidden dress layer 206 can also alternatively be accessed by way of a slit cutout on exposed dress layer 104. Accessory system 100 can be configured so it can be hung on a collapsible hanger 111 for storage in any desired location. Accessory system can have an overall length of 33 inches, with a waist width of about 10 inches, and a bottom of dress width of about 16 inches. Alternatively, these measurements can be varied in order to suit user need.

According to certain embodiments, accessory system 100 can also include ruffles 108 layered on the top of jewelry dress 102, following the shape of a neckline 110. Ruffles 108 can be either V-neck shaped as illustrated, or alternatively round-neck shaped, square neck shaped, flower shaped or any other similar or desirable shape. Accessory system 100 can further include one or more lines of trim 112 coupled to jewelry dress 102 which can be configured with a hook and loop material to allow various jewelry tabs 530 (shown in FIGS. 5A and 5B), 630 (shown in FIGS. 6A and 6B), 730 (shown in FIGS. 7A and 7B) or 1130 (shown in FIGS. 11A and 11B) with corresponding hook and look surfaces to be coupled thereon in a removable manner. Alternatively lines of trim 112 can be configured so as to allow removable coupling of jewelry tabs 530, 630, 730 and/or 1130 by snaps, magnets, ties, or any other similar method of attaching jewelry tabs 530, 630, 730 and/or 1130. According to certain embodiments, trim 112 can be configured in such a way that jewelry tabs 530, 630, 730 and/or 1130 can be permanently coupled to trim 112 on jewelry dress 102 by sewing, gluing, stapling or any method of fusing the material of trim 112 to the material of jewelry tabs 530, 630, 730 and/or 1130.

According to certain embodiments, accessory system 100 can further include one or more pockets 114 that provide areas where different types of jewelry and/or accessories can be neatly stored and organized. The front of pockets 114 can be completely or partially made of a transparent or translucent material 116 through which the jewelry/accessories can be viewed. Pockets 114 can be configured to contain larger accessories such as—but not limited to—bracelets, bangles or any larger items. Pockets 114 can be coupled to jewelry dress 102 in a permanent manner by sewing, gluing, stapling or any method of fusing the material of pockets 114 to the material of jewelry dress 102. Alternatively pockets 114 can be coupled to jewelry dress 102 in a removable manner by snaps, magnets, ties, buttons, or any other similar method of attaching jewelry tabs 530, 630, 730 and/or 1130. According to certain embodiments, transparent or translucent material 116 includes but is not limited to mesh, lace, plastic, or any other similar material.

According to certain embodiments, pockets 114 can be configured such that a top opening 118 of pockets 114 can be made of an elastic material which stretches to expand/open pockets 114 and contracts in the closed position so as to keep accessories/jewelry in place in pockets 114 during transportation and prevent jewelry from falling out. Pockets 114 can also be configured with hook and look closures to keep pockets 114 in the closed position. Alternatively, pockets 114 can have a top opening configured with fastening mechanisms such as zips, snap closures, ties, interlocking tabs and slots or any other similar fastening mechanisms to prevent the jewelry/accessories from falling out of pockets 114 during transportation.

FIG. 2 illustrates an exemplary front view of an inner hidden layer 206 of an accessory organization, secure storage and transportation system 100 according to certain embodiments. As shown in FIG. 2, inner hidden layer 206 can include two opposing fabric layers of the same or different construction and/or color which can be coupled together by sewing, gluing, stapling or any method of fusing the two opposing layers together. Inner hidden layer 206 can be configured such that it is a layer separate from outer exposed dress layer 104 as shown in FIG. 2 or inner hidden layer 206 can be configured such that it is located on the opposite, inner side of outer exposed dress layer 104. Inner hidden layer 206 can include a panel made of but not limited to cardboard, plastic sheeting, interfacing or other supporting material which is housed between the two opposing fabric layers and kept in place by stitched seams 220 which keep the two opposing fabric layers coupled to each other. Alternatively seams 220 can be made by sewing, gluing or stapling the two opposing fabric layers together. Such a construction segments inner hidden layer 206 into one or more portions 226 which can give structure to flexible accessory system 100 during folding, allowing each of the one or more segments to be folded into a more compact package for transportation. This type of construction further cushions the jewelry and accessories and reduces the likelihood of their being damaged during storage and transportation.

According to certain embodiments, the panel can alternatively be made of polyurethane foam, polyester batting or any other material that can provide the rigidity necessary to allow accessory system 100 to be folded in such a manner as described. Seams 220 separating the portions of inner hidden layer 206 containing the panels can be spaced at vertical intervals 222 of 2 inches apart to facilitate folding. Alternatively, this distance can be varied based on the number and width of portions 226.

Inner hidden layer 206 further can include one or more hook and loop strip(s) 224 coupled to inner hidden layer 206 permanently by sewing, gluing, stapling or any method of fusing hook and loop strip(s) 224 onto inner hidden layer 206. Alternatively hook and loop strip(s) 224 can be coupled in a removable manner to inner hidden layer 206 by a magnet on both surfaces or any similar method of attachment. Hook and loop strips 224 can be configured to receive a corresponding hook and loop surface located on one or more jewelry dress travel purses (shown in FIGS. 3, 8, 9 and 10) so as to couple the travel purse(s) to inner hidden layer 206. In this way, any of travel purses 850 (shown in FIG. 8) or 1050 (shown in FIG. 10) containing several pieces of jewelry is stored safely in an inconspicuous manner on hidden layer 206 of accessory system 100.

Figure 3:
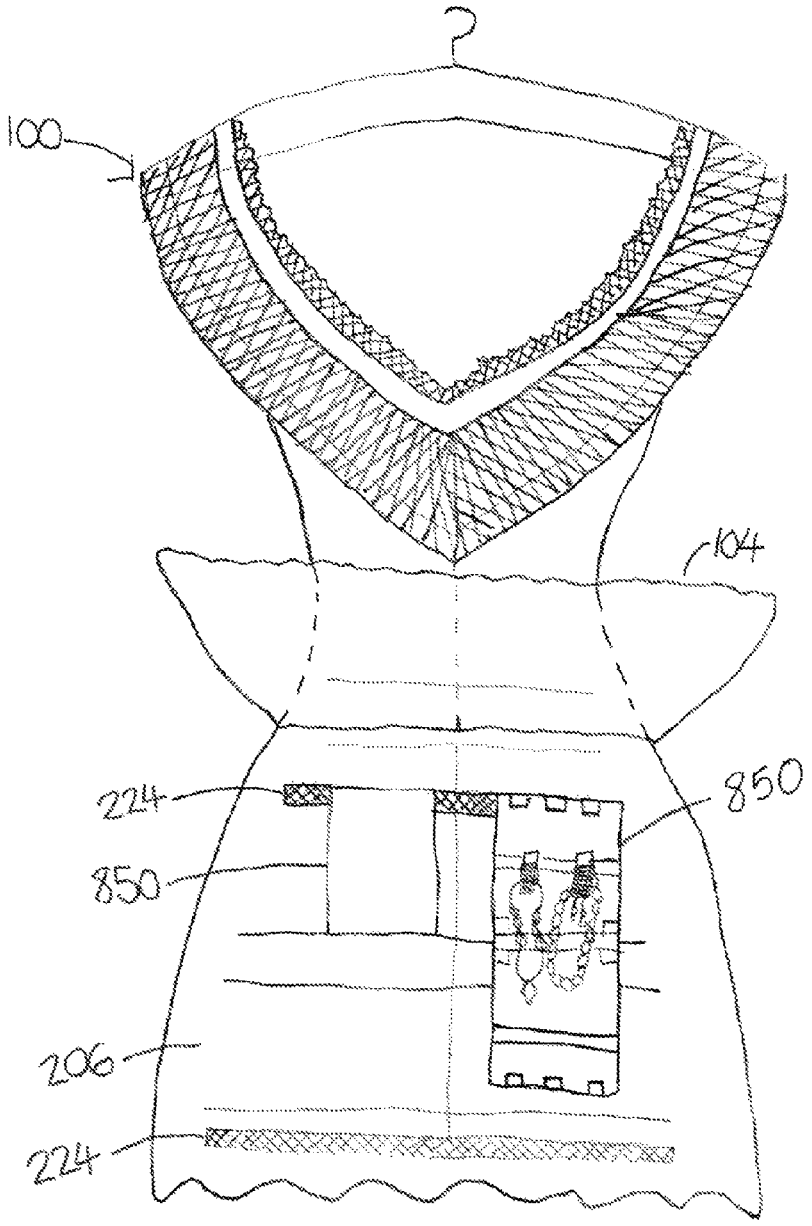
FIG. 3 illustrates an exemplary front view of the inner hidden layer of the accessory organization, secure storage and transportation system with a travel purse in an open configuration coupled to it, and a travel purse in a closed configuration coupled to the inner layer according to certain embodiments.
Figure 8:
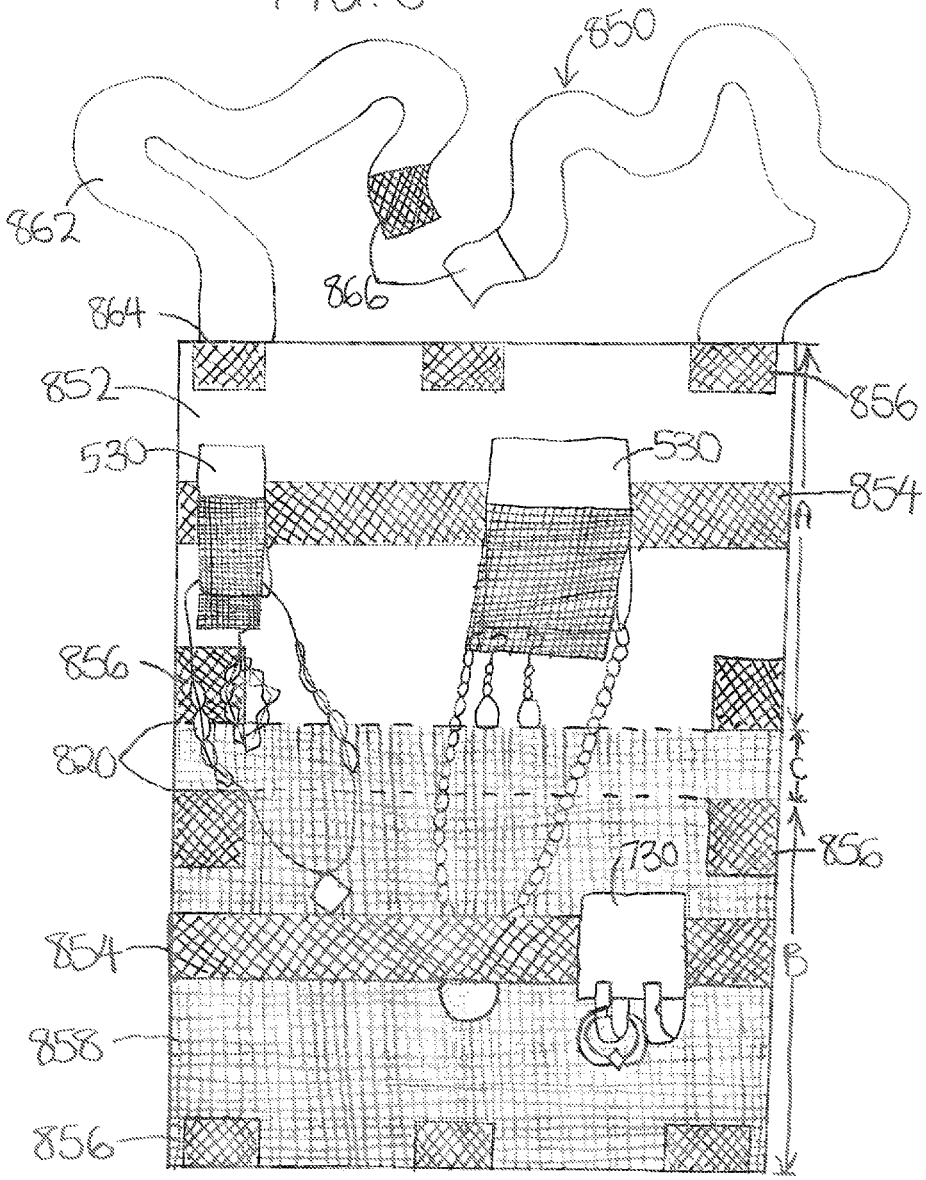
FIG. 8 illustrates an exemplary view of an accessory system travel purse in an open configuration according to certain embodiments.
Figure 9:
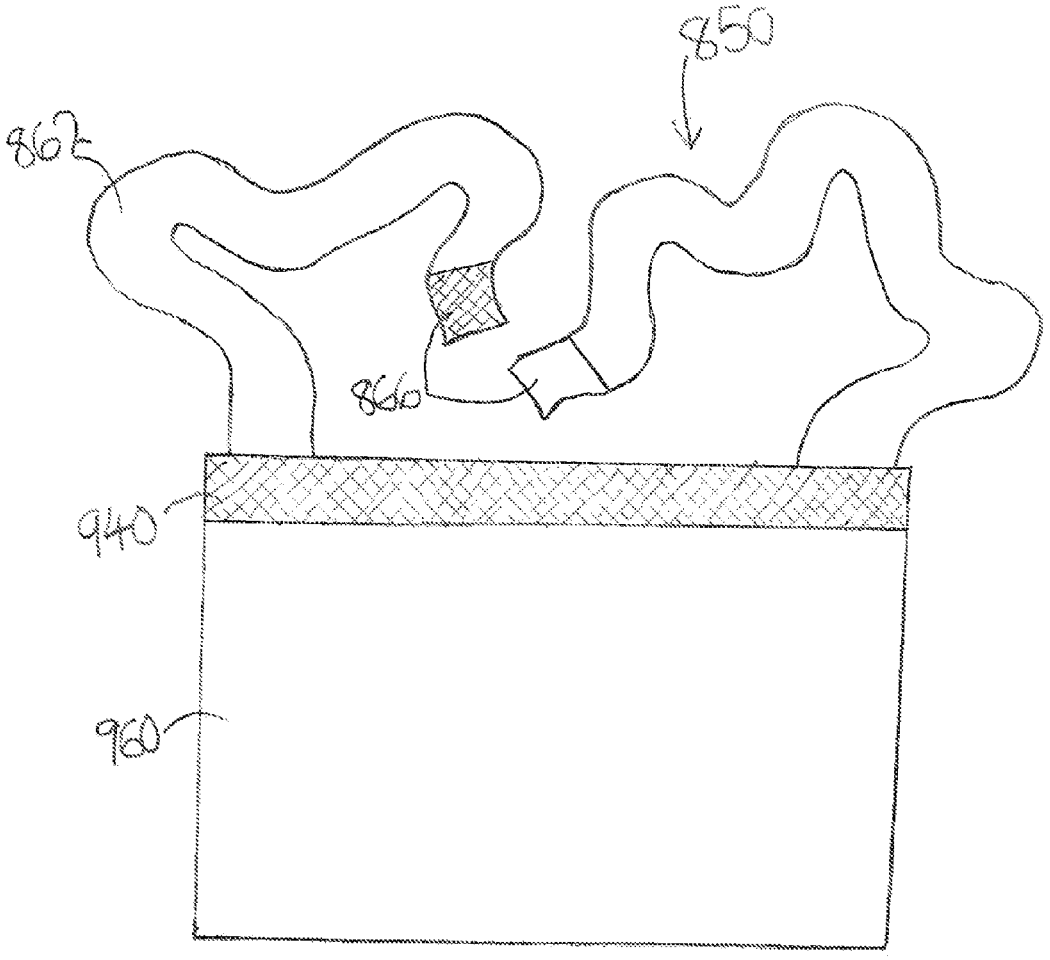
FIG. 9 illustrates an exemplary view of the accessory system travel purse in a closed configuration according to certain embodiments.

FIG. 3 illustrates an exemplary front view of inner hidden layer 206 of an accessory organization, secure storage and transportation system 100 with travel purse 850 (as shown in FIG. 8) in an open configuration coupled to it, and another travel purse 850 (as shown in FIG. 9) in a closed configuration coupled to inner hidden layer 206 according to certain embodiments. As shown in FIG. 3, one or more travel purses 850 (as shown in FIG. 8) containing jewelry/accessories can be coupled to inner hidden layer 206 of accessory system 100 in a removable manner so as to allow for storage within accessory system 100. Travel purse(s) 850 can then also be removed and transported separately with all the jewelry stored therein in an organized and easily accessible manner. Travel purse 850 illustrates how the different types of jewelry/accessories can be stored in travel purse 850 in both an open and a closed configuration.

In accessory system 100's hanging configuration, inner hidden layer 206 and any travel purses stored thereon are not readily visible to an observer. This configuration provides greater security for the pieces of jewelry/accessories stored in travel purse(s) 850 and/or 1050 (shown in FIG. 10) on hidden layer 206 as these pieces will not be readily visible to anyone approaching the location of accessory system 100 for the purpose of stealing jewelry/accessories. Travel purse(s) 850 and/or 1050 and any jewelry stored therein will be hidden on inner hidden layer 206, located under outer exposed dress layer 104. Accessory system 104 will thus only give the impression of no more than a small pretty dress hanging on a hanger in the closet.

Figure 4:
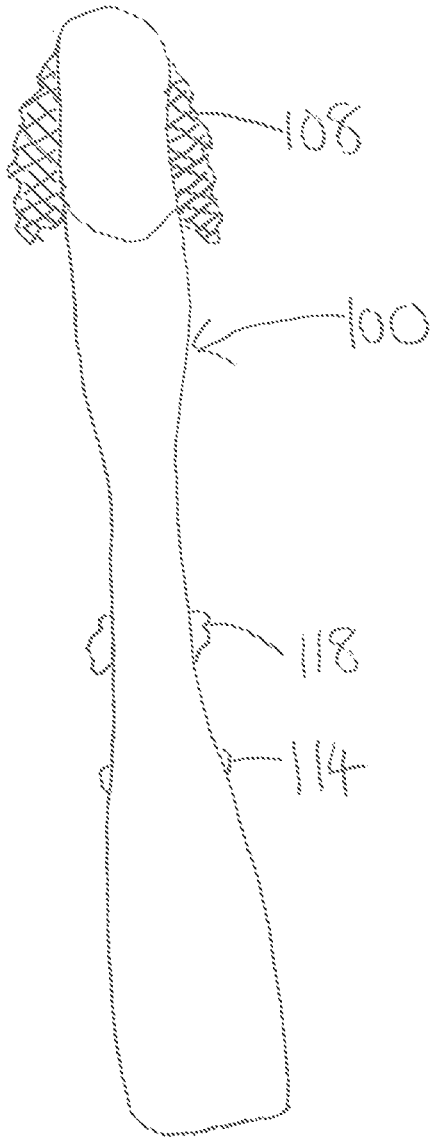
FIG. 4 illustrates an exemplary side view of the accessory organization, secure storage and transportation system according to certain embodiments.

FIG. 4 illustrates an exemplary side view of an accessory organization, secure storage and transportation system 100 according to certain embodiments. As shown in FIG. 4, accessory system 100 can be narrow in thickness, measuring approximately 1 inch or less with nothing stored on inner hidden layer 206 and approximately 1 inch or greater with inner hidden layer 206 having one or more travel purses 850, 1050 and/or one or more of jewelry tabs 530, 630, 730 and/or 1130 stored thereon, thus making it substantially 2-dimensional in shape and further bolstering the appearance of just a dress with nothing being stored on its interior. Accessory system 100 from the side view looks substantially flat thereby not making it obvious to an observer that accessory system 100 has hidden interior storage.

Figure 5A:
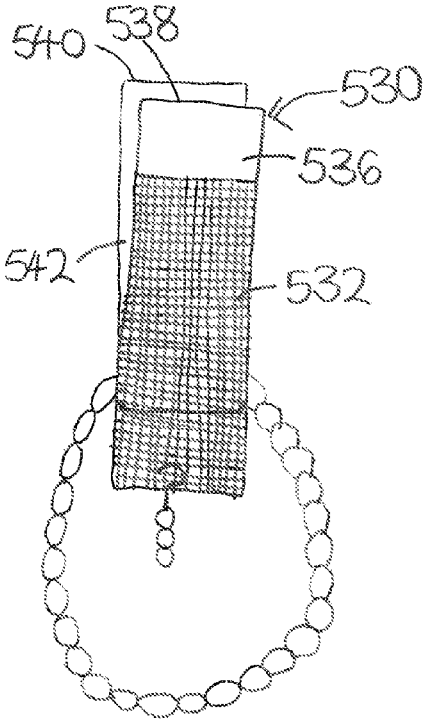
FIG. 5A illustrates an exemplary front view of an accessory system earrings, necklaces, and bracelets tab according to certain embodiments.

FIG. 5A illustrates an exemplary front view of a jewelry earrings, necklaces, and bracelets tab 530 according to certain embodiments. As shown in FIG. 5A, tab 530 is made of a flexible yet sturdy material layer 536 such as but not limited to felt or velvet. Layer 536 is folded in half so as to allow a proximal end 538 and a distal end 540 of layer 536 to be side-by-side as opposing ends—each end having a corresponding hook and loop closure material thus allowing proximal end 538 to fasten to distal end 540. Alternatively, other types of closures can be used including ties, interlocking tabs and slots, snap closures, or any other similar closures. This configuration creates a closed loop on tab 530 in which jewelry such as but not limited to bracelets, necklaces or watches can be hung between the inner opposing felt layers 542. According to certain embodiments, a mesh layer 532 can be coupled to the front side of layer 536 by sewing, gluing, stapling or any method of fusing mesh layer 532 to layer 536 of tab 530. Mesh layer 532 can be configured in a manner that jewelry such as earrings can be hung off the holes in mesh layer 532. Tab 530 is thereby configured to carry and store earrings, necklaces, bracelets and the like. Tab 530 can be configured with a total overall length of 2 inches and an overall width of 1 inch. Alternatively, these measurements can be varied in order to suit user need.

Figure 5B:
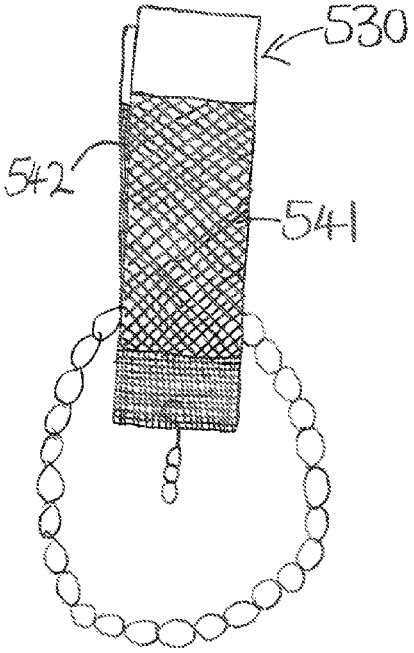
FIG. 5B illustrates an exemplary back view of the accessory system earrings, necklaces, and bracelets tab according to certain embodiments.

FIG. 5B illustrates an exemplary back view of a jewelry earrings, necklaces, and bracelets tab 530 according to certain embodiments. As shown in FIG. 5B, tab 530 further includes a hook and loop layer 541 coupled to the back side of felt layer 536 by sewing, gluing, stapling or any method of fusing hook and loop layer 541 to felt layer 536 of tab 530. Hook and loop layer 541 can be configured to allow tab 530 to be coupled to a corresponding hook and loop layer on jewelry travel purse 328 as shown in FIG. 3 or FIG. 8 or on layer 224 as shown in FIG. 3 or on trim 112 as shown on FIG. 1.

Figure 6A:
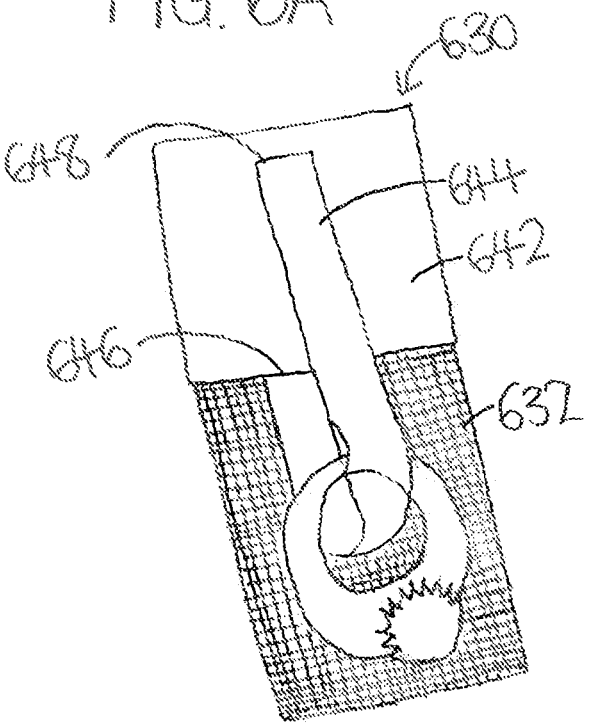
FIG. 6A illustrates an exemplary front view of an accessory system dress rings, etc. tab according to certain embodiments.

FIG. 6A illustrates an exemplary front view of a jewelry dress rings, etc. tab 630 according to certain embodiments. As shown in FIG. 6A, tab 630 can include a felt strip 644 coupled to a rectangular shaped felt layer 642 at a proximal end 646 of felt strip 644 and at a distal end 648 of felt strip 644. This configuration creates a closed loop on tab 630 on which jewelry such as but not limited to rings and necklaces can be hung. Felt strip 644 can be coupled to felt layer 642 in a removable manner by a hook and loop closure at distal end 648 in order to hold the rings and other accessories in place for secure storage and transportation. Alternatively, other types of closures can be used including ties, interlocking tabs and slots, snap closures, or any other similar closures According to certain embodiments, a mesh layer 632 is coupled to felt layer 642 by sewing, gluing, stapling or any method of fusing mesh layer 632 to felt layer 642 of tab 630. Mesh layer 632 is configured in a manner that jewelry such as earrings can be hung off the holes in mesh layer 632. Tab 630 is thereby configured to carry and store earrings, rings and the like. Tab 630 can be configured with a total overall length of 2 inches and an overall width of 1 inch. Alternatively, these measurements can be varied in order to suit user need.

Figure 6B:
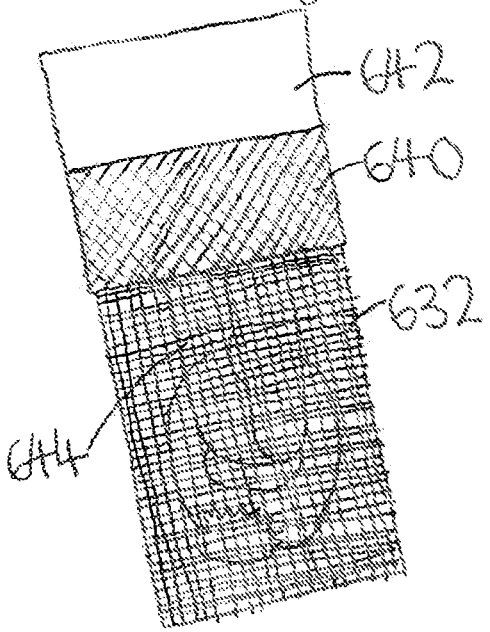
FIG. 6B illustrates an exemplary back view of the accessory system rings, etc. tab according to certain embodiments.

FIG. 6B illustrates an exemplary back view of a jewelry dress rings, etc. tab 630 according to certain embodiments. As shown in FIG. 6B, tab 630 can further include a hook and loop layer 640 coupled to felt layer 642 by sewing, gluing, stapling or any method of fusing hook and loop layer 640 to felt layer 642 of tab 630. Hook and loop layer 640 can be configured to allow tab 630 to be coupled to a corresponding hook and loop layer on jewelry travel purse 328 as shown in FIG. 3 or FIG. 8 or on layer 224 as shown in FIG. 3 or on trim 112 as shown on FIG. 1. According to certain embodiments, strip 644 can be coupled to felt layer 642 in a fixed manner by sewing, gluing, stapling or any method of fusing proximal end of felt strip 644 to felt layer 642. Alternatively, felt strip 644 can be coupled to felt layer 642 in a removable manner by hook and loop closures, magnets, ties, interlocking tabs and slots, snap closures, or any other similar closures.

Figure 7A:
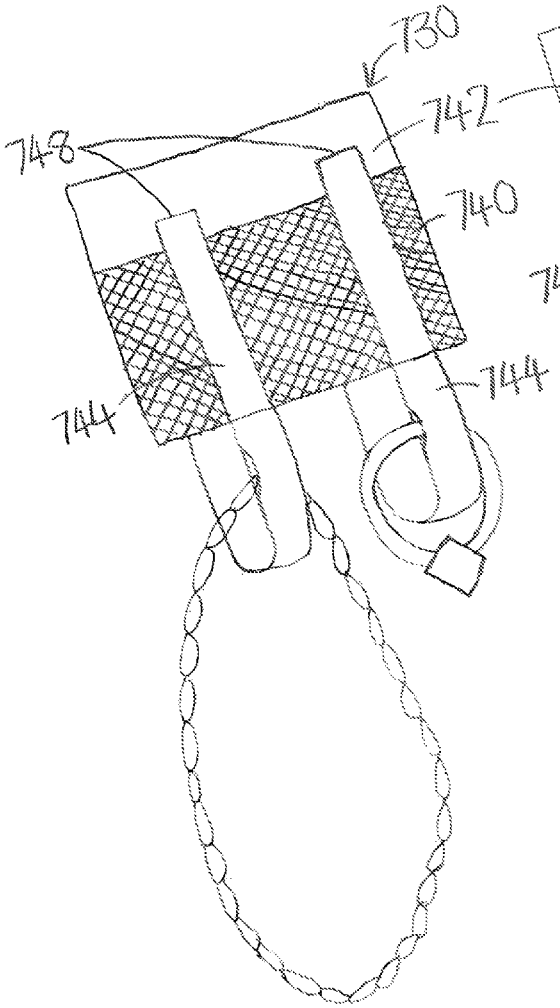
FIG. 7A illustrates an exemplary front view of a second accessory system rings, etc. tab according to certain embodiments.

FIG. 7A illustrates an exemplary front view of a second jewelry dress rings, etc. tab 730 according to certain embodiments. As shown in FIG. 7A, tab 730 can include one or more felt strips 744 coupled to a rectangular shaped felt layer 742 at a proximal end 746 (shown in FIG. 7B) of felt strip 744 and at a distal end 748 of felt strip 744. This configuration creates one or more closed loops on tab 730 on which jewelry such as but not limited to rings, bracelets, necklaces and watches can be hung. According to certain embodiments, felt strip 744 can be coupled to felt layer 742 in a removable manner by a hook and loop closure at distal end 748 in order to hold the rings and other accessories in place for secure storage and transportation. Alternatively, other types of closures can be used including ties, interlocking tabs and slots, snap closures, or any other similar closures. Tab 730 can further include a hook and loop layer 740 coupled to felt layer 742 by sewing, gluing, stapling or any method of fusing hook and loop layer 740 to felt layer 742 of tab 730. Hook and loop layer 740 can be configured to allow tab 730 to be coupled to a corresponding hook and loop layer on jewelry travel purse 328 (as shown in FIG. 3) or jewelry travel purse 850 (as shown in FIG. 8) or on layer 224 as shown in FIG. 3 or on trim 112 as shown in FIG. 1. Felt layer 742 can be configured with a length of 1.5 inches and a width of 1.5 inches. Felt strip 744 can be configured with an overall length of 2 inches. Alternatively, these measurements can be varied in order to suit user need.

Figure 7B:
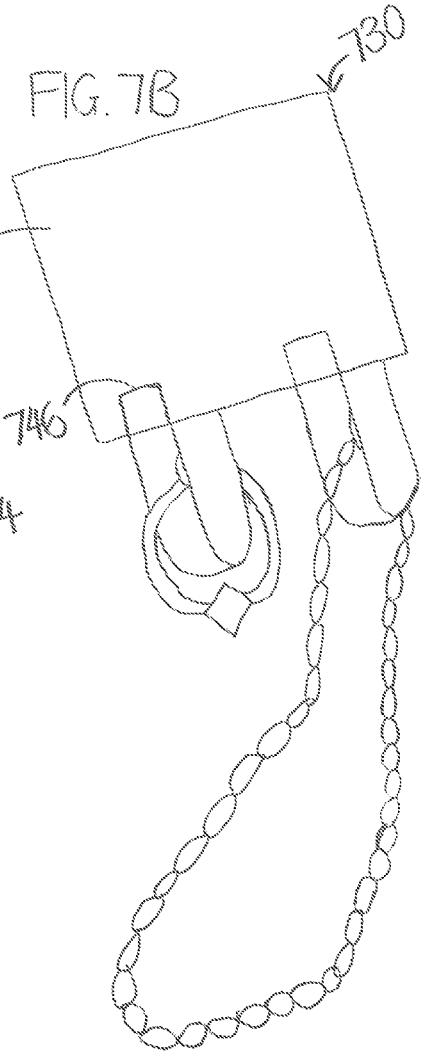
FIG. 7B illustrates an exemplary back view of the second accessory system rings, etc. tab according to certain embodiments.

FIG. 7B illustrates an exemplary back view of a second jewelry dress rings, etc. tab according to certain embodiments. As shown in FIG. 7B, tab 730 can include one or more felt strips 744 coupled to a rectangular shaped felt layer 742 at a proximal end 746. Strip 744 can be coupled to felt layer 742 in a fixed manner by sewing, gluing, stapling or any method of fusing proximal end of strip 744 to felt layer 742. Alternatively, strip 744 can be coupled to felt layer 742 in a removable manner by hook and loop closures, magnets, ties, interlocking tabs and slots, snap closures, or any other similar closures.

FIG. 8 illustrates an exemplary view of a jewelry dress travel purse 850 in an open configuration according to certain embodiments. As shown in FIG. 8, travel purse 850 can include two opposing fabric layers—the first layer being an outer layer 960 (visible in the closed position as shown in FIG. 9) and the second being an inner layer 852 (visible in the open position). Opposing fabric layers 960 (shown in FIG. 9) and 852 can be of the same or different construction and/or color and can be coupled together permanently by sewing, gluing, stapling or any method of fusing the two opposing layers together. Travel purse 850 also can include a panel made of but not limited to cardboard, plastic sheeting, interfacing or other supporting material which can be housed between two opposing fabric layers 852 and 960 in each of section A and section B and kept in place by stitched seams 820 which give travel purse 850 some rigidity and keep opposing fabric layers coupled to each other in such a way as to define at least two distinct portions A and B. Alternatively seams 820 can be made by sewing, gluing or stapling the two opposing fabric layers together. Such a construction segments the inner layer 852 into at least two distinct portions A and B and gives structure to flexible travel purse 850 during folding. This allows each of two or more segments A and B to be folded over each other in travel purse 850's closed position (shown in FIG. 9) for storage and transportation. This type of construction further cushions the jewelry and accessories and reduces the likelihood of their being damaged during storage and transportation.

According to certain embodiments, the panel can alternatively be made of polyurethane foam, polyester batting or any other material that can provide the rigidity necessary to allow the jewelry system to be folded in such a manner as described. The seams 820 separating section A and section B (at least one of which contains a panel) can be spaced a vertical distance C of one half of an inch apart to facilitate folding. Alternatively, this distance can be varied based on the number of sections like A and B and length of such portions.

According to certain embodiments, inner layer 852 can be made of any variety of one or more flexible materials such as—but not limited to—felt, woven fabrics, knit fabrics, non-woven fabrics, leather, artificial leather, vinyl, flexible composites, coated fabrics, or any other similar materials. In addition, inner layer 852 can have an additional mesh layer 858 coupled to the top of inner layer 852 by sewing, gluing, stapling or any method of fusing mesh layer 858 to inner layer 852. Mesh layer 858 can be configured in a manner that jewelry such as earrings can be hung off the holes in mesh layer 858.

According to certain embodiments, travel purse 850 can further include multiple hook and loop surfaces 854 which allow for coupling of any of jewelry tabs 530, 630, 730 or 1130 (shown in FIGS. 11A and 11B) with a similar hook and loop surface. This way different items of jewelry can be stored on any of jewelry tabs 530, 630, 730 or 1130 and transferred to travel purse 850, or 950 (shown in FIG. 9) to be packaged in an organized manner with travel purse 850 then being stored in a hidden manner on inner hidden layer 206 (shown in FIG. 3) of accessory system 100. In this way jewelry is hidden in accessory system 100 in an inconspicuous manner and kept safe from someone looking to steal jewelry/accessories who would simply see a pretty dress hanging. Travel purse 850 can conveniently be removed from accessory system 100 and be transported separately, thus keeping the desired subset of jewelry pieces in an organized manner which is easy to access.

According to certain embodiments, travel purse 850 can further include multiple hook and loop surfaces 856 coupled to inner layer 852 on section A which allow for coupling to corresponding hook and loop surfaces 856 on section B to secure travel purse 850 in a folded or closed configuration. Additionally, travel purse 850 can include two or more straps 862 coupled to outer layer 960 in a fixed manner by sewing, gluing, stapling or any method of fusing a proximal end 864 of each of straps 862 to outer layer 960. Alternatively, straps 862 can be coupled to outer layer 960 in a removable manner by hook and loop closures, magnets, ties, interlocking tabs and slots, snap closures, or any other similar closures. Straps 862 can each include hook and loop surfaces on each of terminal ends 866 which can be coupled to each other to form a closed loop and can be used to carry travel purse 850 on an individual's shoulder as a handbag would be carried. Alternatively, straps 862 can be wrapped around travel purse 850 in the closed configuration and coupled together at terminal ends 866 so as to provide a tighter closure to travel purse 850.

FIG. 9 illustrates an exemplary view of a jewelry dress travel purse 850 in a closed configuration according to certain embodiments. As shown in FIG. 9, travel purse 850 can include outer layer 960 and one or more hook and loop strips 940 coupled to outer layer 960. Outer layer 960 can be made of any variety of one or more flexible materials such as—but not limited to—felt, woven fabrics, knit fabrics, non-woven fabrics, leather, artificial leather, vinyl, flexible composites, coated fabrics, or any other similar materials. One or more hook and loop strip(s) 940 can be coupled to outer layer 960 either permanently by sewing, gluing, stapling or any method of fusing hook and loop strip(s) 940 onto outer layer 960. Alternatively, one or more hook and loop strip(s) 940 can be coupled in a removable manner to outer layer 960 by a magnet on both surfaces and any similar method of attachment. Straps 862 each include hook and loop surfaces on each of terminal ends 866 which can be coupled to each other to form a closed loop which can be used to carry travel purse 850 on an individual's shoulder as a handbag would be carried. Alternatively, straps 862 can be wrapped around travel purse 850 in the closed configuration and coupled together at each of terminal ends 866 so as to provide a tighter closure to travel purse 850. Hook and loop strip (s) 940 can be configured to be coupled to corresponding hook and loop strip(s) 224 on hidden layer 206 of accessory system 100 as shown in FIG. 3.

Figure 10:
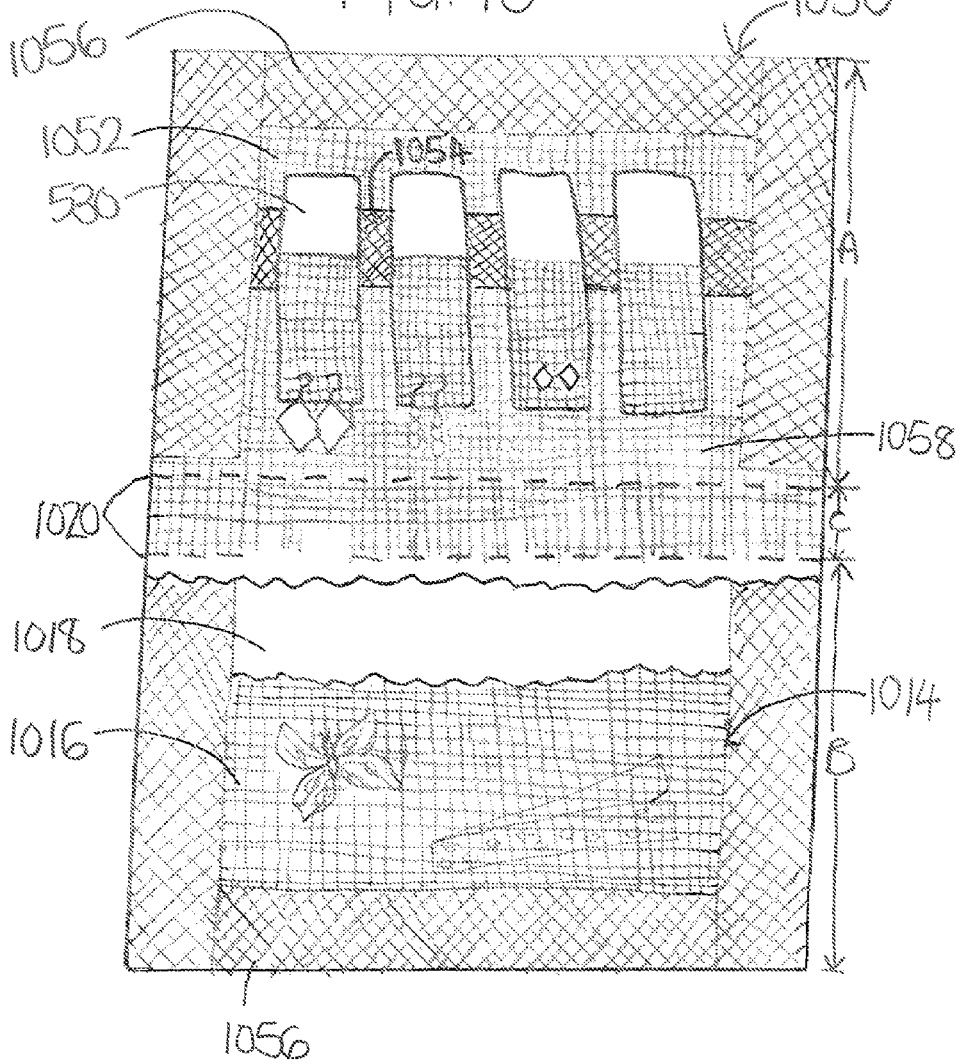
FIG. 10 illustrates an exemplary view of a second accessory system travel purse in an open configuration according to certain embodiments.

FIG. 10 illustrates an exemplary view of a second jewelry dress travel purse 1050 in an open configuration according to certain embodiments. As shown in FIG. 10, travel purse 1050 is similar in construction to travel purse 850 (shown in FIGS. 9 and 10) and can include two opposing fabric layers—the first layer being an outer layer (not shown) similar to outer layer 960 of jewelry travel purse 850 (shown in FIG. 9) and an inner layer 1052 (visible in the open position). The outer layer (not shown) and inner layer 1052 can be of the same or different construction and/or color and can be coupled together permanently by sewing, gluing, stapling or any method of fusing the two opposing layers together. Travel purse 1050 also can include a panel made of but not limited to cardboard, plastic sheeting, interfacing or other supporting material which can be housed between the outer layer and inner layer 1052 in each of section A and section B of travel purse 1050 and kept in place by stitched seams 1020 in such a way as to define at least two distinct portions A and B. Alternatively seams 1020 can be made by sewing, gluing or stapling the two opposing fabric layers together. Such a construction segments inner layer 1052 into at least two distinct portions A and B and gives structure to flexible travel purse 1050 during folding. This allows each of two or more segments A and B to be folded over each other to close travel purse 1050 for storage and transportation. This type of construction further cushions the jewelry and accessories and reduces the likelihood of their being damaged during storage and transportation. Travel purse 850 can be configured with a total overall length of 10.5 inches and an overall width of 6 inches in the open position. Alternatively, these measurements can be varied in order to suit user need.

According to certain embodiments, the panel can alternatively be made of polyurethane foam, polyester batting or any other material that can provide the rigidity necessary to allow accessory system 100 to be folded in such a manner as described. Seams 1020 separating section A and section B (at least one of which contains a panel) can be spaced a vertical distance C of one half of 1 inch apart to facilitate folding. Alternatively, this distance can be varied based on the number of sections like A and B and length of such portions.

According to certain embodiments, inner layer 1052 can be made of any variety of one or more flexible materials such as—but not limited to—felt, woven fabrics, knit fabrics, non-woven fabrics, leather, artificial leather, vinyl, flexible composites, coated fabrics, or any other similar materials. In addition, inner layer 1052 can have an additional mesh layer 1058 coupled to the top of inner layer 1052 by sewing, gluing, stapling or any method of fusing mesh layer 1058 to inner layer 1052. Mesh layer 1058 can be configured in a manner that jewelry such as earrings can be hung off the holes in mesh layer 1058.

According to certain embodiments, travel purse 1050 can further include multiple hook and loop surfaces 1054 which allow for coupling of any of jewelry tabs 530, 630, 730 or 1130 (shown in FIGS. 11A and 11B) with a similar hook and loop surface. This way different items of jewelry can be stored on the various tabs and transferred to travel purse 1050 in an organized manner with travel purse 1050 then being stored in a hidden manner on inner hidden layer 206 (shown in FIG. 3) of accessory system 100. In this way jewelry is hidden in accessory system 100 in an inconspicuous manner and kept safe from someone looking to steal jewelry who would simply see a pretty dress hanging. Travel purse 1050 can conveniently be removed from accessory system 100 and be transported separately, thus keeping the desired subset of jewelry pieces in an organized manner which is easy to access. Additionally, travel purse 1050 further includes multiple hook and loop surfaces 1056 coupled to the perimeter of inner layer 1052 on section A which allow for coupling to corresponding hook and loop surfaces 1056 on section B to secure travel purse 1050 in a folded or closed configuration.

According to certain embodiments, travel purse 1050 can include one or more pockets 1014 that provide separate areas where different types of jewelry and accessories can be neatly stored and organized. The front of pockets 1014 can be completely or partially made of a transparent or translucent material 1016 through which the jewelry/accessories can be viewed. Pockets 1014 can be configured to contain slightly larger accessories such as—but not limited to— bracelets, brooches and hair clips. Pockets 1014 can be coupled to inner layer 1052 in a permanent manner by sewing, gluing, stapling or any method of fusing the material of pockets 1014 to the material of inner layer 1052. Alternatively pockets 1014 can be coupled to inner layer 1052 in a removable manner by snaps, magnets, ties, or any other similar method of attaching the tabs. According to certain embodiments, transparent or translucent material 1016 includes but is not limited to mesh, lace, plastic, or any other similar material.

According to certain embodiments pockets 1014 can be configured such that a top opening 1018 of pockets 1014 can be made of an elastic material which stretches to expand/open the pocket and contracts in the closed position so as to keep accessories/jewelry in place in pocket 1014 during transportation and prevent jewelry from falling out. Pockets 1014 can also be configured with hook and look closures to keep pockets 1014 in the closed position. Alternatively, pockets 1014 can have a top opening configured with fastening mechanisms such as zips, snap closures, ties, interlocking tabs and slots or any other similar fastening mechanisms to prevent the jewelry/accessories from falling out of pockets 1014 during transportation.

Figure 11A:
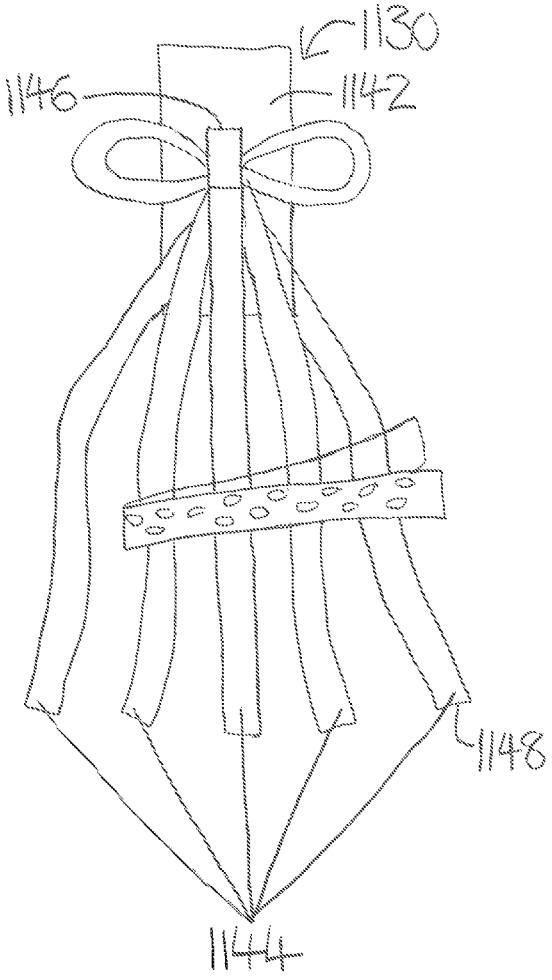
FIG. 11A illustrates an exemplary front view of an accessory system accessory tab according to certain embodiments.

FIG. 11A illustrates an exemplary front view of a jewelry dress accessory tab 1130 according to certain embodiments. As shown in FIG. 11A, tab 1130 can include one or more felt strips 1144 coupled to a rectangular shaped felt layer 1142 at a proximal end 1146 of one or more felt strip(s) 1144. One or more felt strip(s) 1144 are free/unattached at distal end(s) 1148. This configuration creates one or more loose strips on tab 1130 on which jewelry such as but not limited to hair clips, clip-on earrings, and clip-on brooches can be hung. According to certain embodiments, one or more felt strip(s) 1144 can be coupled to felt layer 1142 in a fixed manner by sewing, gluing, stapling or any method of fusing one or more felt strip(s) 1144 to felt layer 1142. One or more felt strip(s) 1144 can also be coupled to felt layer 1142 in a removable manner by a hook and loop closure at proximal end 1146. Alternatively, other types of closures can be used including ties, interlocking tabs and slots, snap closures, or any other similar closures. Furthermore tab 1130 can be made of any variety of one or more flexible materials other than felt, such as—but not limited to—woven fabrics, knit fabrics, non-woven fabrics, leather, artificial leather, vinyl, flexible composites, coated fabrics, or any other similar materials. Felt layer 1142 can be configured with a length of 1.5 inches and a width of 1 inch. Felt strips 1144 can be configured with an overall length of 4 inches. Alternatively, these measurements can be varied in order to suit user need.

Figure 11B:
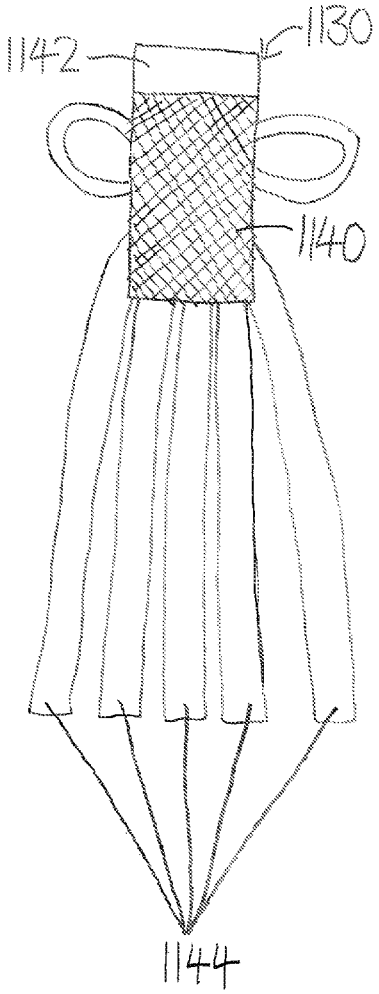
FIG. 11B illustrates an exemplary back view of the accessory system accessory tab according to certain embodiments.

FIG. 11B illustrates an exemplary back view of a jewelry dress accessory tab 1130 according to certain embodiments. As shown in FIG. 11B, tab 1130 can further include a hook and loop layer 1140 coupled to felt layer 1142 by sewing, gluing, stapling or any method of fusing hook and loop layer 1140 to felt layer 1142 of tab 1130. Hook and loop layer 1140 can be configured to allow tab 1130 to be coupled to a corresponding hook and loop layer on jewelry travel purses 850 (as shown in FIG. 8) or jewelry travel purse 1050 (as shown in FIG. 10) or on layer 224 as (shown in FIG. 3) or on trim 112 (as shown in FIG. 1).

Figure 12:
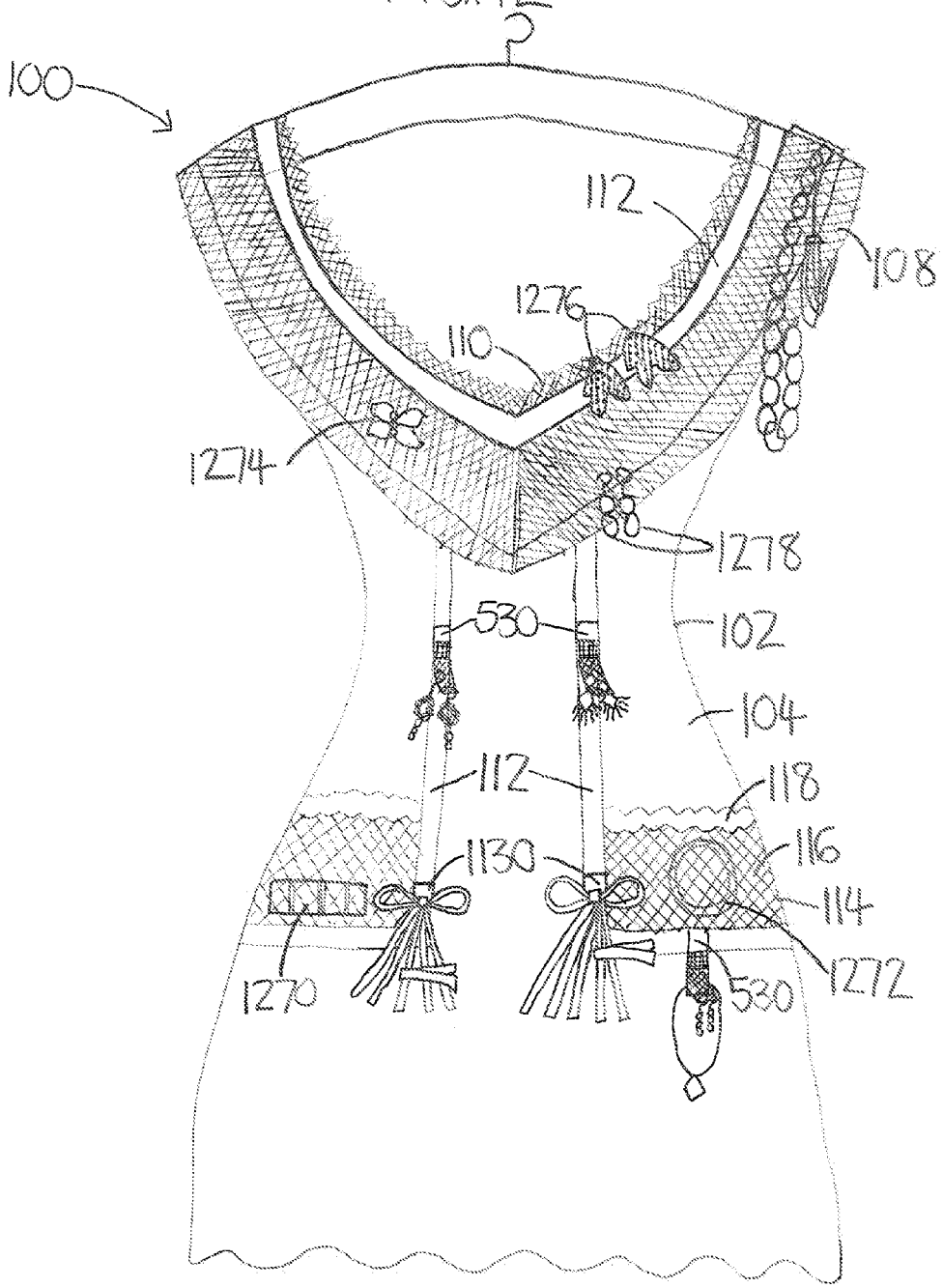
FIG. 12 illustrates an exemplary front view of an accessory organization, secure storage and transportation system according to certain embodiments.

FIG. 12 illustrates an exemplary front view of an accessory organization, secure storage and transportation system 100 according to certain embodiments. As shown in FIG. 12, an exemplary accessory system 100 generally includes a jewelry dress 102 with an outer exposed layer 104 and an inner hidden dress layer 206 (shown in FIG. 2). Outer exposed dress layer 104 can be made of any variety of one or more flexible materials such as—but not limited to—woven fabrics, knit fabrics, non-woven fabrics, leather, artificial leather, vinyl, flexible composites, coated fabrics, or any other similar materials.

According to certain embodiments, accessory system 100 also includes ruffles 108 layered on the top of jewelry dress 102, following the shape of a neckline 110. Various pieces of jewelry such as brooches 1274, dangling earrings 1276 and 1278 can be hung from ruffles 108. Ruffles 108 can be either V-neck shaped as illustrated, or alternatively round-neck shaped, square neck shaped, flower shaped or any other similar or desirable shape. Accessory system 100 further includes one or more lines of trim 112 coupled to jewelry dress 102 which can be configured with a hook and loop material to allow one or more of jewelry dress earrings, necklaces, and bracelets tab 530, jewelry dress rings, etc. tab 630, second jewelry dress rings, etc. tab 730 or jewelry dress accessory tab 1130 with corresponding hook and look surfaces to be coupled thereon in a removable manner. Alternatively the lines of trim 112 can be configured so as to allow removable coupling of the aforementioned tabs by snaps, magnets, ties, or any other similar method of attaching the tabs. Trim 112 can also be configured in such a way that tabs 530, 630, 730 and/or 1130 can be permanently coupled to trim 112 on jewelry dress 102 by sewing, gluing, stapling or any method of fusing the material of trim 112 to the material of tabs 530, 630, 730 and/or 1130.

According to certain embodiments accessory system 100 further includes one or more pockets 114 that provide separate and distinct areas where different types of jewelry and accessories can be neatly stored and organized. The front of pockets 114 can be completely or partially made of a transparent or translucent material 116 through which the jewelry/accessories can be viewed. Pockets 114 can be configured to contain larger accessories such as—but not limited to—bracelets 1270, bangles 1272 or any larger jewelry items. Pockets 114 can be coupled to jewelry dress 102 in a permanent manner by sewing, gluing, stapling or any method of fusing the material of pockets 114 to the material of dress 102. Alternatively pockets 114 can be coupled to dress 102 in a removable manner by snaps, magnets, ties, or any other similar method of attaching the tabs. Transparent or translucent material 116 can include but is not limited to mesh, lace, plastic, or any other similar material.

According to certain embodiments pockets 114 can be configured such that top opening 118 of pockets 114 can be made of an elastic material which stretches to expand/open the pocket and contracts in the closed position so as to keep accessories/jewelry in place in pockets 114 during transportation and prevent jewelry from falling out. Pockets 114 can also be configured with hook and look closures to keep pockets 114 in the closed position. Alternatively, pockets 114 can have a top opening configured with fastening mechanisms such as zips, snap closures, ties, interlocking tabs and slots or any other similar fastening mechanisms to prevent the jewelry/accessories from falling out of pockets 114 during transportation.

Figure 13:
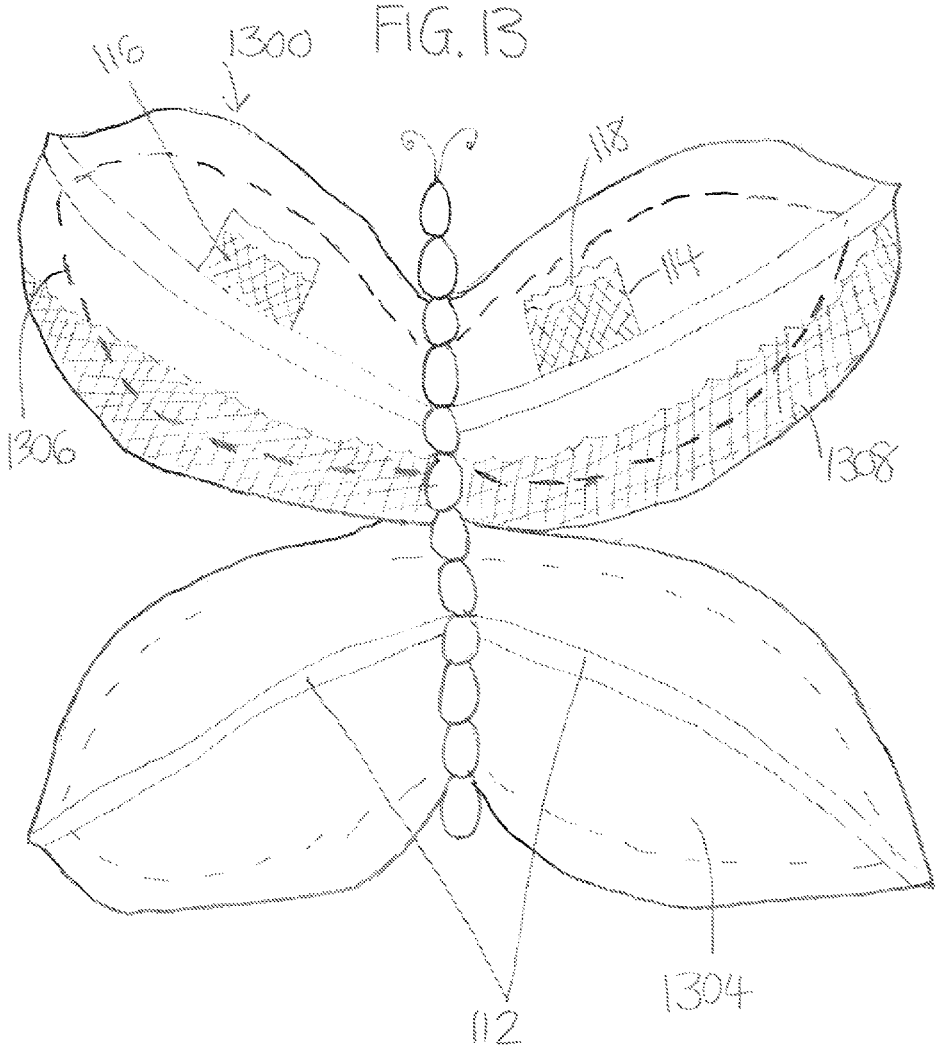
FIG. 13 illustrates an exemplary front view of a butterfly shaped accessory organization, secure storage and transportation system according to certain embodiments.

FIG. 13 illustrates an exemplary front view of a butterfly shaped accessory organization, secure storage and transportation system 1300 according to certain embodiments. As shown in FIG. 13, accessory system 1300 is a variation in shape of accessory system 100 performs some or all of the same functions as accessory system 100 and can include some or all of the same features described in accessory system 100. Accessory system 1300 generally includes an outer exposed layer 1304, an inner hidden layer 1306 configured with hook and loop strips so as to couple one or more jewelry dress travel purse(s) 850, 1050 to hidden layer 1306, one or more pockets 114 which can be completely or partially made of a transparent or translucent material 116 and have a top opening 118, a ruffle layer 1308 for hanging jewelry pieces such as earrings on, and one or more lines of trim 112 which can be configured with a hook and loop material to allow various jewelry tabs 530, 630, 730 and 1130 with corresponding hook and loop surfaces to be coupled thereon in a removable manner.

Figure 14:
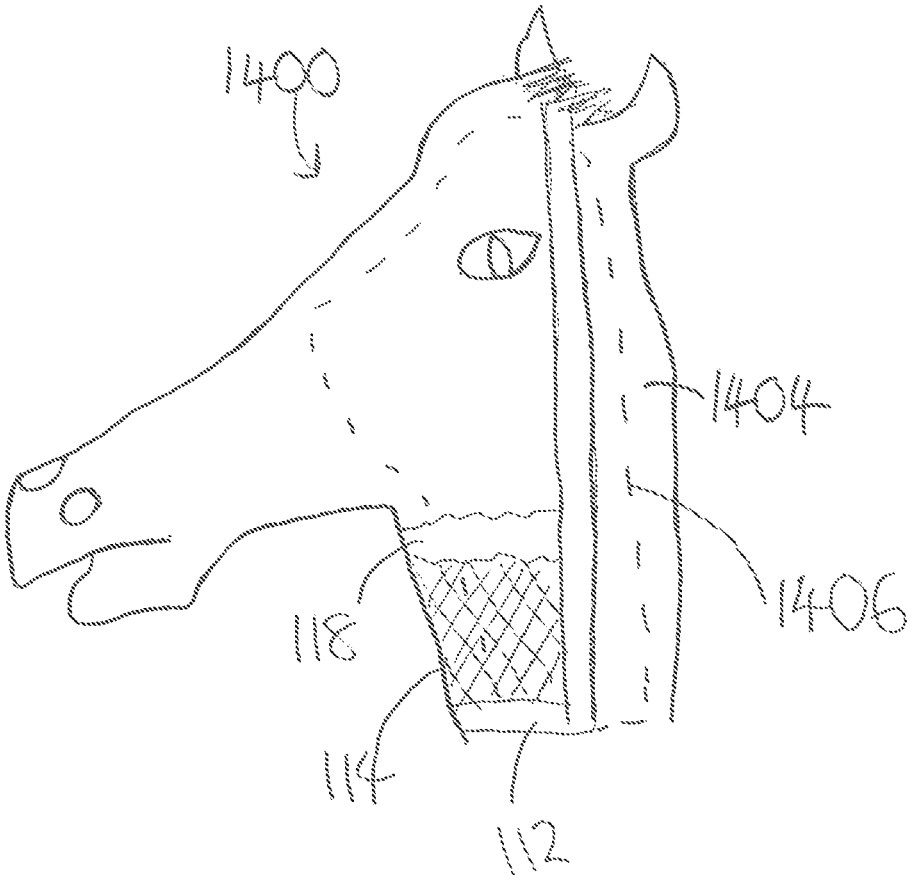
FIG. 14 illustrates an exemplary front view of a horse head shaped accessory organization, secure storage and transportation system according to certain embodiments.

FIG. 14 illustrates an exemplary front view of a horse head shaped accessory organization, secure storage and transportation system according to certain embodiments. As shown in FIG. 14, accessory system 1400 is a variation in shape of accessory system 100, performs some or all of the same functions as accessory system 100 and can include some or all of the same features described in accessory system 100. Accessory system 1400 generally includes an outer exposed layer 1404, an inner hidden layer 1406 configured with hook and loop strips so as to couple one or more jewelry dress travel purse(s) 850, 1050 to hidden layer 1406, one or more pockets 114 which can be completely or partially made of a transparent or translucent material 116 and have a top opening 118, and one or more lines of trim 112 which can be configured with a hook and loop material to allow various jewelry tabs 530, 630, 730 and 1130 with corresponding hook and loop surfaces to be coupled thereon in a removable manner.

Figure 15:
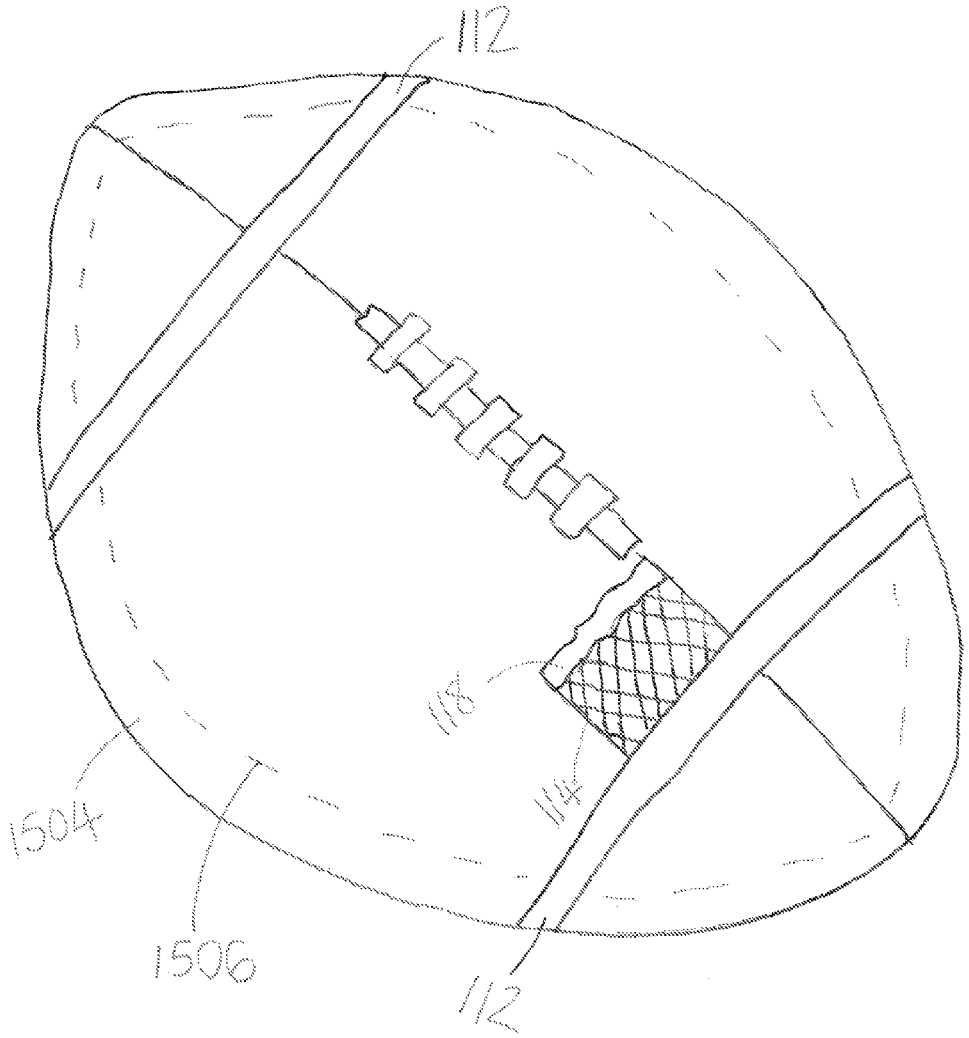
FIG. 15 illustrates an exemplary front view of a football shaped accessory organization, secure storage and transportation system according to certain embodiments.

FIG. 15 illustrates an exemplary front view of a football shaped accessory organization, secure storage and transportation system according to certain embodiments. As shown in FIG. 15, accessory system 1500 is a variation in shape of accessory system 100, performs some or all of the same functions as accessory system 100 and can include some or all of the same features described in accessory system 100. Accessory system 1500 generally includes an outer exposed layer 1504, an inner hidden layer 1506 configured with hook and loop strips so as to couple one or more jewelry dress travel purse(s) 850, 1050 to hidden layer 1506, one or more pockets 114 which can be completely or partially made of a transparent or translucent material 116 and have a top opening 118, and one or more lines of trim 112 which can be configured with a hook and loop material to allow various jewelry tabs 530, 630, 730 and 1130 with corresponding hook and loop surfaces to be coupled thereon in a removable manner.

Figure 16:
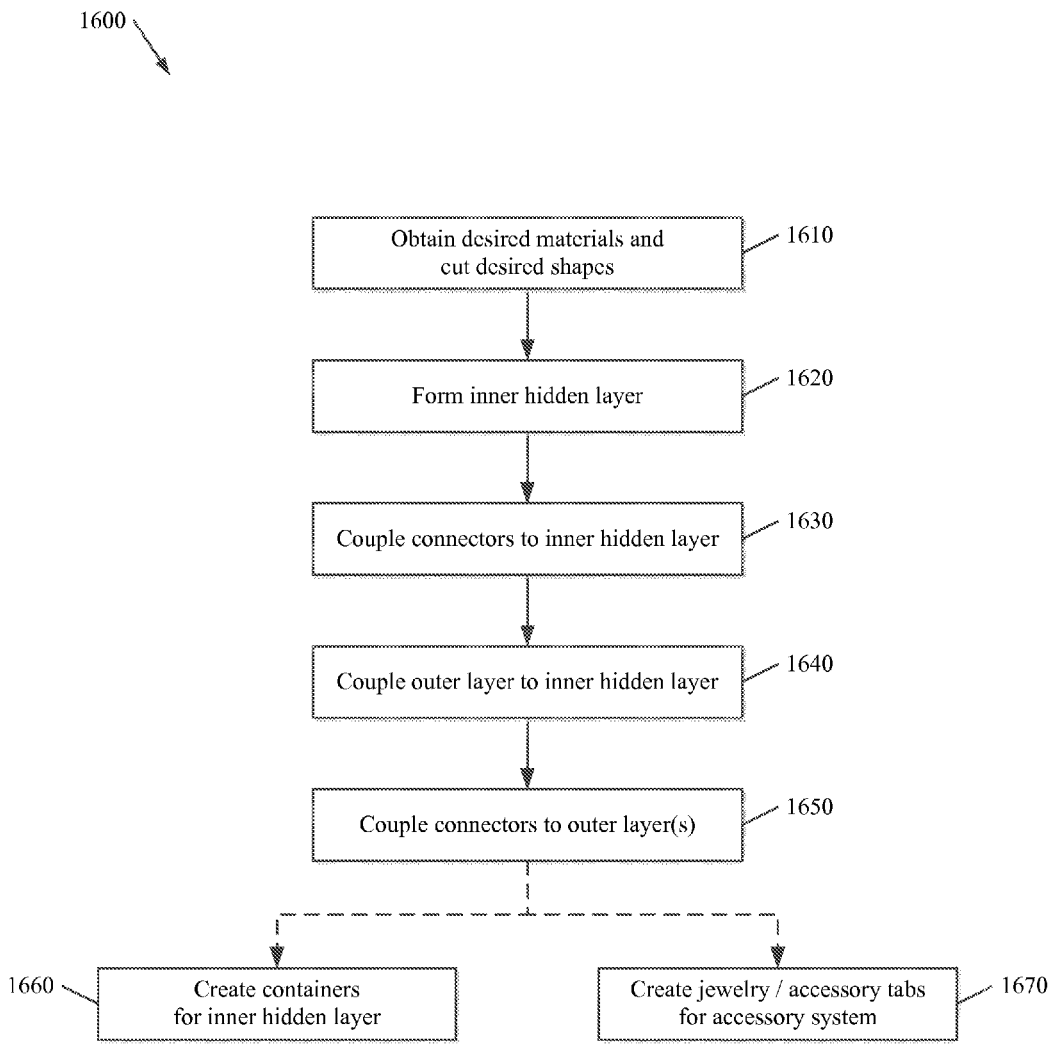
FIG. 16 illustrates an exemplary flowchart for making/manufacturing an accessory organization, secure storage and transportation system according to certain embodiments.

FIG. 16 illustrates an exemplary flowchart 1600 for making/manufacturing an accessory organization, secure storage and transportation system according to certain embodiments.

At 1610, flowchart 1600 begins with obtaining desired materials and cutting the desired shapes. The shapes can include all or part of dress shapes as shown in FIG. 1, butterfly shapes as show in FIG. 13, horse head shapes as shown in FIG. 15, and/or football shapes as shown in FIG. 15. These shapes will be used to make the different components that make up accessory system 100. The materials can be made of any variety of one or more flexible materials such as—but not limited to—woven fabrics, knit fabrics, non-woven fabrics, leather, artificial leather, vinyl, flexible composites, coated fabrics, or any other similar materials. Furthermore, other materials mentioned elsewhere in this disclosure can be picked for various components of accessory system such as—but not limited to—mesh, felt, lace, cardboard and any similar materials.

At 1620, flowchart 1600 continues with forming inner hidden layer 260, 1306 or 1406, which may include placing and coupling one or more panels between two opposing layers of material to form inner hidden layer 206, 1306, or 1406. As shown in FIG. 2, inner hidden layer 206 can include two opposing fabric layers of the same or different construction and/or color. Inner hidden layer 206 can be configured such that it is a layer separate from outer exposed dress layer 104 as shown in FIG. 2 or inner hidden layer 206 can be configured such that it is located on the opposite, inner side of outer exposed dress layer 104. Inner hidden layer 206 can include a panel made of but not limited to cardboard, plastic sheeting, interfacing or other supporting material which is housed between the two opposing fabric layers. According to certain embodiments, the panel can alternatively be made of polyurethane foam, polyester batting or any other material that can provide the rigidity necessary to allow accessory system 100 to be folded in such a manner as described elsewhere in this disclosure.

As shown in FIG. 2, inner hidden layer 206 can include two opposing fabric layers of the same or different construction and/or color which can be coupled together by sewing, gluing, stapling or any method of fusing the two opposing layers together. The panel which is housed between the two opposing fabric layers can be kept in place by stitched seams 220 which keep the two opposing fabric layers coupled to each other. Alternatively seams 220 can be made by sewing, gluing or stapling the two opposing fabric layers together. Such a construction segments inner hidden layer 206 into one or more portions 226 which can give structure to flexible accessory system 100 during folding, allowing each of the one or more segments to be folded into a more compact package for transportation. This type of construction further cushions the jewelry and accessories and reduces the likelihood of their being damaged during storage and transportation. Seams 220 separating the portions of inner hidden layer 206 containing the panels can be spaced at vertical intervals 222 of 2 inches apart to facilitate folding. Alternatively, this distance can be varied based on the number and width of portions 226.

At 1630, flowchart 1600 continues with coupling connectors, such as, for example, one or more hook and loop surfaces, to inner hidden layer, which may be performed earlier within flowchart 1600. As shown in FIG. 2, inner hidden layer 206 can include one or more hook and loop strip(s) 224 coupled to inner hidden layer 206 permanently by sewing, gluing, stapling or any method of fusing hook and loop strip(s) 224 onto inner hidden layer 206. Alternatively hook and loop strip(s) 224 can be coupled in a removable manner to inner hidden layer 206 by a magnet on both surfaces and any similar method of attachment, such as snaps, buttons, zippers, and so on. Hook and loop strips 224 can be configured to receive a corresponding hook and loop surface located on one or more jewelry dress travel purses (shown in FIGS. 3, 8, 9 and 10) so as to couple the travel purse(s) to inner hidden layer 206. In this way, any of travel purses 850 (shown in FIG. 8) or 1050 (shown in FIG. 10) containing several pieces of jewelry is stored safely in an inconspicuous manner on hidden layer 206 of accessory system 100.

At 1640, flowchart 1600 continues with coupling at least one outer layer of material to inner hidden layer to finish the basic accessory system shape. As shown in FIG. 1, outer exposed dress layer 104 can be made of any variety of one or more flexible materials such as—but not limited to—woven fabrics, knit fabrics, non-woven fabrics, leather, artificial leather, vinyl, flexible composites, coated fabrics, or any other similar materials. The back view (not shown) of outer exposed layer 104 can be identical to the front view, or not, with all elements on the front view being included on the back view. Outer exposed layer 104 can be configured such that it is a layer separate from inner hidden layer 206 as shown in FIG. 2 or inner hidden layer 206 can be configured such that it is located on the opposite, inner side of outer exposed dress layer 104. Outer exposed layer 104 can be lifted up in order to access and expose inner hidden layer 206. Alternatively, outer exposed layer 104 can be configured with a zip that can be unzipped to expose inner hidden layer 206. Outer exposed layer 104 can also be configured with a slit cutout though which inner hidden layer 206 can be accessed and exposed. Accessory system 100 can then be finished by adding any decorative trim such as ruffles 108, painting, adding decorative stitches and patterns to accessory system 100.

At 1650, flowchart 1600 continues with coupling connectors, such as, for example, one or more hook and look surfaces, or pockets, to outer layer(s), which may be performed earlier within flowchart 1600. In certain embodiments, the connectors discussed herein can be coupled to either the front or back outer layer (or both) of accessory system 100. As shown in FIG. 1, accessory system 100 can include one or more lines of trim 112 coupled to jewelry dress 102 which can be configured with a hook and loop material to allow various jewelry tabs 530 (shown in FIGS. 5A and 5B), 630 (shown in FIGS. 6A and 6B), 730 (shown in FIGS. 7A and 7B) or 1130 (shown in FIGS. 11A and 11B) with corresponding hook and look surfaces to be coupled thereon in a removable manner. Alternatively lines of trim 112 can be configured so as to allow removable coupling of jewelry tabs 530, 630, 730 and/or 1130 by snaps, magnets, ties, or any other similar method of attaching jewelry tabs 530, 630, 730 and/or 1130. According to certain embodiments, trim 112 can be configured in such a way that jewelry tabs 530, 630, 730 and/or 1130 can be permanently coupled to trim 112 on jewelry dress 102 by sewing, gluing, stapling or any method of fusing the material of trim 112 to the material of jewelry tabs 530, 630, 730 and/or 1130.

According to certain embodiments, accessory system 100 can further include one or more pockets 114 that provide areas where different types of jewelry and/or accessories can be neatly stored and organized. The front of pockets 114 can be completely or partially made of a transparent or translucent material 116 through which the jewelry/accessories can be viewed. Pockets 114 can be configured to contain larger accessories such as—but not limited to—bracelets, bangles or any larger items. Pockets 114 can be coupled to jewelry dress 102 in a permanent manner by sewing, gluing, stapling or any method of fusing the material of pockets 114 to the material of jewelry dress 102. Alternatively pockets 114 can be coupled to jewelry dress 102 in a removable manner by snaps, magnets, ties, buttons, or any other similar method of attaching jewelry tabs 530, 630, 730 and/or 1130. According to certain embodiments, transparent or translucent material 116 includes but is not limited to mesh, lace, plastic, or any other similar material.

According to certain embodiments, pockets 114 can be configured such that a top opening 118 of pockets 114 can be made of an elastic material which stretches to expand/open pockets 114 and contracts in the closed position so as to keep accessories/jewelry in place in pockets 114 during transportation and prevent jewelry from falling out. Pockets 114 can also be configured with hook and look closures to keep pockets 114 in the closed position. Alternatively, pockets 114 can have a top opening configured with fastening mechanisms such as zips, snap closures, ties, interlocking tabs and slots or any other similar fastening mechanisms to prevent the jewelry/accessories from falling out of pockets 114 during transportation.

At 1660, flowchart 1600 continues with creating one or more jewelry/accessory containers to be coupled to inner hidden layer. This may be optional to the previously discussed ways of making accessory system 100 or performed at any point prior to or during the other parts of flowchart 1600, which is why it is illustrated using a dashed line from 1650. As shown in FIGS. 8, 9 and 10, one or more jewelry purses can be created and configured to store jewelry/accessories and one or more of jewelry tabs 530, 630, 730 and 1130 thereon. Jewelry purses 850 and 950 can be constructed as described elsewhere in this disclosure and can be configured with one or more hook and loop surfaces to be coupled to corresponding hook and loop surfaces on hidden layer 206 for secure storage and transportation.

At 1670, flowchart 1600 continues with step 1608 of creating one or more jewelry/accessory tabs to be coupled to outer layer(s), inner hidden layer and/or jewelry accessory containers. This may be optional to the previously discussed ways of making accessory system 100 or performed at any point prior to or during the other parts of flowchart 1600, which is why it is illustrated using a dashed line from 1650. As shown in FIGS. 5A, 5B, 6A, 6B, 7A, 7B, 11A and 11B, various jewelry tabs 530, 630, 730 and 1130 can be constructed to carry jewelry/accessories and then be coupled on any one or more of jewelry containers 850 and 1050, or to inner hidden layers 206, 1306, 1406, or 1506, or to outer exposed layer 104, 1304, 1404, or 1504. Jewelry tabs 530, 630, 730 and 1130 can be constructed as described elsewhere in this disclosure.

After learning the teachings of this disclosure, it will be evident to those skilled in the art that many, many variations can be made to the disclosed embodiments. These variations may include, but are not limited to, differing sizes, dimensions, shapes, materials, layers, attachment means, feature quantities, feature placement, manufacturing steps or step ordering and so on. All of such variations, as well as many others, are intended to be within the scope of the claims.

The invention claimed is:

1. A protective and concealment system for storing and displaying accessories comprising:

a. a vessel comprising:
   - i. an exterior vessel surface comprising a plurality of vessel attachment locations;
   - ii. one or more concealment flaps, wherein said one or more concealment flaps comprise a fixed end attached to said exterior vessel surface, and a free end opposite to said fixed end, and wherein said one or more concealment flaps covers and conceals one or more of said vessel attachment locations;
   - iii. a plurality of rigid panels separated by vertical intervals and configured to facilitate folding of the protective and concealment system for storing and displaying accessories; and
   - iv. a mesh surface configured to allow for the hanging of accessories for removable storage and display of said accessories; and b. one or more containers comprising:
   - i. an interior surface and an exterior surface;
   - ii. a plurality of exterior attachment points on said exterior surface;
   - iii. one or more interior attachment points on said interior surface;

wherein said one or more containers are removably attached to one of said vessel attachment locations in a plurality of user-defined configurations; and wherein said one or more containers are attached to said vessel by removably attaching exterior attachment points to said vessel attachment locations; and c. one or more modules comprising a module attachment point wherein;

i. said one or more modules are configured to receive, store, protect and display one or more accessory items;

ii. said one or more modules are attached to said vessel by removably attaching said module attachment point to one of said vessel attachment locations;

iii. said one or more modules are removably attached to said vessel attachment locations in said plurality of user-defined configurations; and iv. said one or more modules are removably attached to said one or more interior attachment points in a plurality of user defined configurations.

2. The system of claim 1, wherein said vessel attachment locations further comprise a removable attachment means.

3. The system of claim 1, wherein said exterior vessel surface further comprises an exterior storage unit further comprising:

a. a pocket;

b. ruffles; and c. a plurality of felt strips attached to said vessel at one end.

4. The system of claim 1, wherein said vessel is configured to be hung from a clothes hanger.

5. The system of claim 1, where said one or more containers further comprise a carrying strap, wherein said carrying strap is removably attached to said exterior attachment points; and wherein said carrying strap is operatively configured by a user for transportation or display.

6. The system of claim 1, wherein said interior surface of said one or more containers further comprises an accessory storage and display pocket.

7. A protective and concealment system for storing and displaying accessories comprising: a. a vessel comprising: i. an exterior vessel surface comprising a plurality of vessel attachment locations; ii. one or more concealment flaps, wherein said one or more concealment flaps comprise a fixed end attached to said exterior vessel surface, and a free end opposite to said fixed end; wherein said one or more concealment flaps covers and conceals one or more of said vessel attachment locations; and wherein said vessel is configured to resemble a garment; iii. a plurality of rigid panels separated by vertical intervals and configured to facilitate folding of the protective and concealment system for storing and displaying accessories; and iv. a mesh surface configured to allow for the hanging of accessories for removable storage and display of said accessories; and b. one or more containers comprising: i. an interior surface and an exterior surface; ii. a plurality of exterior attachment points on said exterior surface; iii. one or more interior attachment points on said interior surface; wherein said one or more containers are removably attached to one of said vessel attachment locations in a plurality of user-defined configurations; and wherein said one or more containers are attached to said vessel by removably attaching exterior attachment points to said vessel attachment locations; and c. one or more modules comprising a module attachment point wherein; i. said one or more modules are configured to receive, store, protect and display one or more accessory items; ii. said one or more modules are attached to said vessel by removably attaching said module attachment point to one of said vessel attachment locations.

8. The system of claim 7, wherein said vessel attachment locations further comprise a removable attachment means.

9. The system of claim 7, wherein said exterior vessel surface further comprises an exterior storage unit further comprising:

a. a pocket;

b. ruffles; and c. a plurality of felt strips attached to said vessel at one end.

10. The system of claim 7, wherein said vessel is configured to be hung from a clothes hanger.

11. The system of claim 7, where said one or more containers further comprise a carrying strap, wherein said carrying strap is removably attached to said exterior attachment points; and wherein said carrying strap is operatively configured by a user for transportation or display.

12. The system of claim 7, wherein said interior surface of said one or more containers further comprises an accessory storage and display pocket.

* * * * *